US009638383B2

(12) United States Patent
Kim

(10) Patent No.: US 9,638,383 B2
(45) Date of Patent: May 2, 2017

(54) LAMP DEVICE FOR VEHICLE

(71) Applicant: HYUNDAI MOBIS Co., Ltd., Yongin-si, Gyeonggi-do (KR)

(72) Inventor: Jeong Yun Kim, Yongin-si (KR)

(73) Assignee: HYUNDAI MOBIS CO., LTD., Yongin-si, Gyeonggi-do (KR)

( * ) Notice: Subject to any disclaimer, the term of this patent is extended or adjusted under 35 U.S.C. 154(b) by 141 days.

(21) Appl. No.: 14/474,468

(22) Filed: Sep. 2, 2014

(65) Prior Publication Data

US 2015/0085512 A1 Mar. 26, 2015

(30) Foreign Application Priority Data

Sep. 26, 2013 (KR) ..... 10-2013-0114586

(51) Int. Cl.
*F21V 7/00* (2006.01)
*F21S 8/10* (2006.01)

(52) U.S. Cl.
CPC ..... *F21S 48/1225* (2013.01); *F21S 48/1388* (2013.01); *F21S 48/215* (2013.01); *F21S 48/225* (2013.01); *F21S 48/2212* (2013.01); *F21S 48/236* (2013.01); *F21S 48/24* (2013.01)

(58) Field of Classification Search
CPC ..... F21S 48/1225; F21S 48/1388
See application file for complete search history.

(56) References Cited

U.S. PATENT DOCUMENTS 6,097,549 A 8/2000 Jenkins et al.
2003/0099113 A1* 5/2003 Gebauer ..... B60Q 1/0052 362/511
2011/0261570 A1* 10/2011 Okada ..... F21S 48/215 362/311.06
2011/0292671 A1* 12/2011 Ishihara ..... F21S 48/215 362/522
2012/0250308 A1 10/2012 Zwak et al.

FOREIGN PATENT DOCUMENTS

DE 102 31 326 A1 2/2004
DE 20 2007 003 497 U1 5/2007
DE 10 2007 005 183 A1 8/2008
DE 10 2009 031 834 A1 1/2011
DE 10 2012 102 105 A1 10/2012

OTHER PUBLICATIONS

Oct. 27, 2015, German Office Action for related DE application No. 102014113735.3.

* cited by examiner

*Primary Examiner* — Andrew Coughlin
*Assistant Examiner* — Meghan Ulanday
(74) *Attorney, Agent, or Firm* — Paratus Law Group, PLLC

(57) ABSTRACT

The present invention provides a lamp device for a vehicle including a light source and an inner lens through which light which is emitted from the light source passes, in which the inner lens includes a lens unit which diffuses light which is emitted from the light source, and a light guiding unit which protrudes toward the light source from the lens unit to guide the light which is emitted from the light source to the lens unit. Light emitted from the light source is guided by the light guiding unit to be incident onto the lens unit and then is irradiated to be diffused to the outside of the vehicle so that the light distribution performance is improved.

16 Claims, 5 Drawing Sheets

LAMP DEVICE FOR VEHICLE

CROSS-REFERENCE TO RELATED APPLICATIONS

The present application claims priority to Korean Patent Application Number 10-2013-0114586 filed Sep. 26, 2013, the entire contents of which application is incorporated herein for all purposes by this reference.

TECHNICAL FIELD

The present invention relates to a lamp device for a vehicle, and more particularly, to a lamp device for a vehicle which uniformly distributes light which is irradiated from a light source.

BACKGROUND

Generally, a lamp device for a vehicle is mounted at a front side, left and right sides, or a rear side of a body of the vehicle to irradiate light from a lamp in a predetermined direction so as to safely drive the vehicle.

The lamp device for a vehicle includes a head lamp which is mounted at the front side of the vehicle and a rear lamp which is mounted at the rear side of the vehicle. The head lamp is a lamp which illuminates the front side while night driving. The rear lamp includes a brake light which is turned on when a driver steps on a brake and turn signals which indicates a heading direction of the vehicle.

Recently, LEDs have been widely used for a light source of a lamp device for a vehicle. A plurality of LEDs is provided on a printed circuit board. However, since a space is formed between the LEDs which are provided on the printed circuit board, when light which is emitted from the LEDs is irradiated to the outside through an inner lens and a bezel, brightness of the light is not uniform and thus a relatively bright portion and a relatively dark portion are simultaneously formed. The light from a center of the LED is direct light which is irradiated through the inner lens and the bezel, so that a hot spot portion is formed.

SUMMARY

The present invention has been made in an effort to provide a lamp device for a vehicle which uniformly distributes light radiated from a light source of the lamp device for a vehicle to be irradiated to the outside of the vehicle.

Objects of the present invention are not limited to the above-mentioned objects, and other objects, which are not mentioned above, can be clearly understood by those skilled in the art from the following descriptions.

An exemplary embodiment of the present invention provides a lamp device for a vehicle including a light source and an inner lens through which light emitted from the light source passes, in which the inner lens includes a lens unit which diffuses light which is emitted from the light source, and a light guiding unit which protrudes toward the light source from the lens unit to guide the light which is emitted from the light source to the lens unit.

A surface of the light guiding unit which is opposite to the light source may be formed to be parallel to a light emitting surface of the light source.

The surface of the light guiding unit which is opposite to the light source may be formed to have substantially the same area as the light emitting surface of the light source.

The light guiding unit may include both surfaces and the both surfaces of the light guiding unit may be obliquely formed to have an interval which is increased toward the lens unit from the light source and the both surfaces of the light guiding unit may be formed to have different tilt angles.

A reflecting layer may be formed on the both surfaces of the light guiding unit.

A light reflecting unit may be formed in the light guiding unit, the light reflecting unit may include both surfaces and the both surfaces of the light reflecting unit may be obliquely formed to have an interval which is gradually increased toward the lens unit, and a reflecting layer may be formed on the both surfaces of the light reflecting unit.

One surface of the light guiding unit and one corresponding surface of the light reflecting unit may be formed to be parallel to each other.

An inside of the light reflecting unit may be formed as a space having a predetermined shape and a cross-section of the space may be a triangle.

An apex which is in contact with both surfaces of the light reflecting unit may be located to be shifted to one side from a center of the light source.

The light guiding unit may have two light guide passages having an interval which is gradually increased toward the lens unit.

A plurality of light sources may be formed and a plurality of light guiding units may be formed corresponding to the light sources.

The light source may be an LED and the LEDs may be formed on a printed circuit board so as to be spaced apart from each other.

A bezel may be disposed at an outer side of the inner lens which is opposite to the light source.

A cross-section of the light guiding unit may have a trapezoidal shape in which an interval between both surfaces is gradually increased toward the lens unit.

A plurality of convex portions may be formed on an outer surface of a main body which is opposite to the light guiding unit.

Other detailed matters of the embodiments are included in the detailed description and the drawings.

The lamp device for a vehicle according to the present invention has the following advantages.

A distribution performance of light which is irradiated from the light source of the lamp device for a vehicle to the outside of the vehicle is improved, thereby achieving more uniform illumination.

Leakage of light which is emitted from the light source is reduced, so that the illumination is improved.

The light which is radiated from the center of the light source is not directly irradiated, so that a hot spot phenomenon is prevented.

A predetermined light distribution performance may be achieved with a reduced number of light sources, so that a cost is reduced and a heating value and power consumption are also reduced.

The effects of the present invention are not limited to the aforementioned effects, and other effects, which are not mentioned above, will be apparently understood by a person skilled in the art from the recitations of the claims.

DETAILED DESCRIPTION

Figure 1:
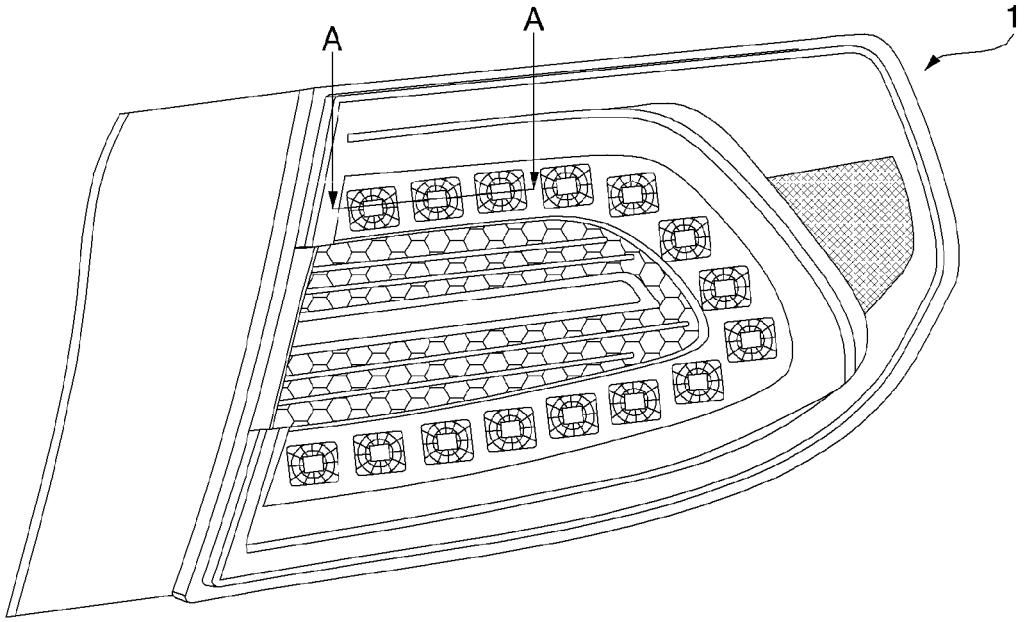
FIG. 1 is a front view illustrating a lamp device for a vehicle according to an exemplary embodiment of the present invention.

Advantages and characteristics of the present invention, and a method of achieving the advantages and characteristics will be clear by referring to exemplary embodiments described below in detail together with the accompanying drawings. However, the present invention is not limited to exemplary embodiments disclosed herein but will be implemented in various forms. The exemplary embodiments introduced herein are provided to make disclosed contents thorough and complete and sufficiently transfer the spirit of the present invention to those skilled in the art. Therefore, the present invention will be defined only by the scope of the appended claims. Like reference numerals designate like elements throughout the specification.

Hereinafter, a lamp device for a vehicle according to an exemplary embodiment of the present invention will be described with reference to the drawings.

The lamp device for a vehicle according to the exemplary embodiment of the present invention may be modified by those skilled in the art.

Figure 2:
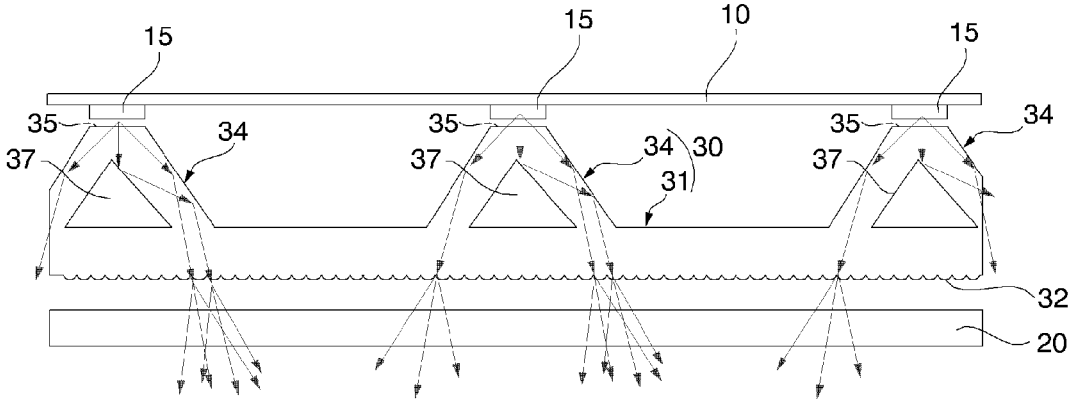
FIG. 2 is a cross-sectional view taken along line A-A of FIG. 1.
Figure 3:
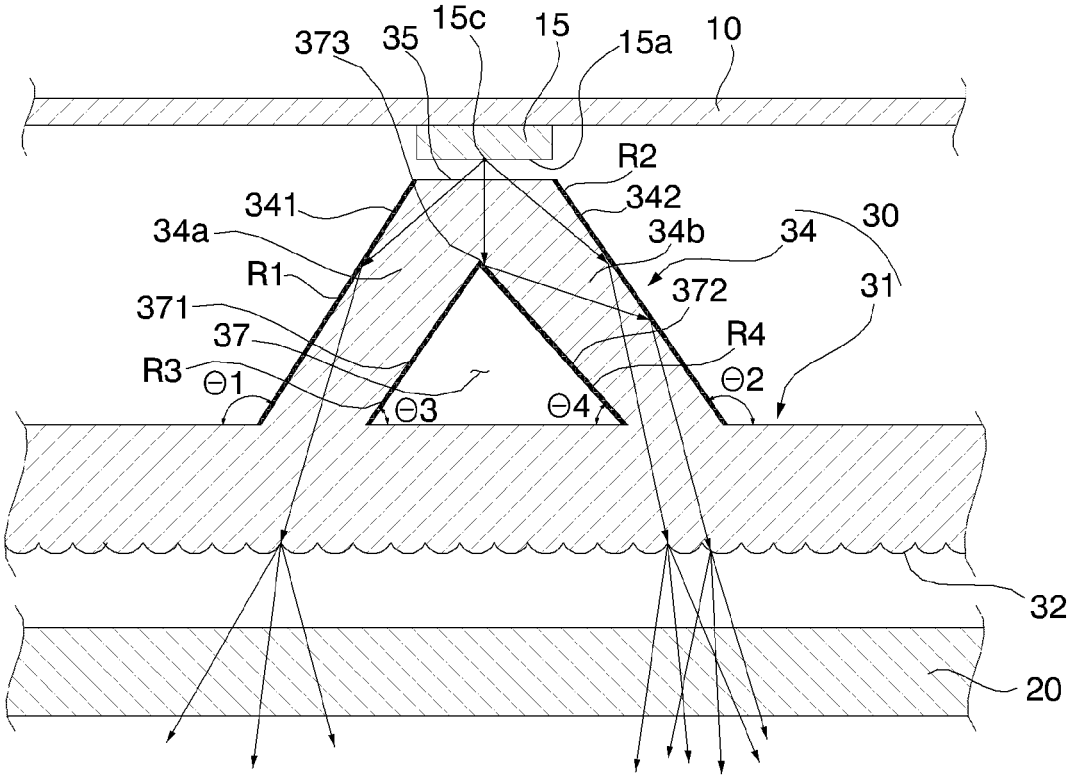
FIG. 3 is a partial enlarged cross-sectional view of FIG. 2.

Referring to FIGS. 2 and 3, the lamp device for a vehicle according to an exemplary embodiment of the present invention includes a light source 15 and an inner lens 30 through which light which is emitted from the light source 15 passes. The inner lens 30 includes a lens unit 31 which diffuses light which is emitted from the light source 15 and a light guiding unit 34 which protrudes toward the light source 15 from the lens unit 31 to guide the light which is emitted from the light source 15 to the lens unit 31.

The lens unit 31 and the light guiding unit 34 may be injection-molded to be integrated.

A bezel through which the light which is diffused through the inner lens 30 is transmitted to be irradiated to the outside of the vehicle may be provided at the outside of the inner lens 30. An LED may be used as the light source 15 and a plurality of LEDs may be provided on a printed circuit board 10 with a predetermined interval.

A surface 35 of the light guiding unit 34 which is opposite to the light source 15 may be formed to be parallel to a light emitting surface 15*a* of the light source.

The surface 35 of the light guiding unit 34 which is opposite to the light source 15 may be formed to have substantially the same area as the light emitting surface 15*a* of the light source.

Both surfaces 341 and 342 of the light guiding unit 34 which totally reflect the light which is incident from the light source 15 into the light guiding unit 34 are formed in an outer direction. The both surfaces 341 and 342 of the light guiding unit may be obliquely formed so as to have an interval which is gradually increased toward the lens unit 31 from the light source 15.

Tilt angles θ1 and θ2 of the both surfaces 341 and 342 of the light guiding unit may be equal to each other or different from each other.

Reflecting layers R1 and R2 on which Al or Ag is deposited may be formed on the both surfaces 341 and 342 of the light guiding unit.

Light reflecting units 371 and 372 are formed in the light guiding unit 34 so that the light which is incident from the light source 15 may be totally reflected to the outer direction of the light reflecting units 371 and 372. The light reflecting unit includes both surfaces 371 and 372 and the both surfaces 371 and 372 of the light reflecting unit may be sloped such that the interval is gradually increased toward the lens unit 31. The reflecting layers R3 and R4 may be formed on the both surfaces 371 and 372 of the light reflecting unit.

Both surfaces 341 and 342 of the light guiding unit may reflect again the light which is reflected from the both surfaces 371 and 372 of the reflecting unit and the both surfaces 371 and 372 of the reflecting unit may reflect again the light which is reflected from the both surfaces 341 and 342 of the light guiding unit.

One of surfaces 341 and 342 of the light guiding unit and one corresponding surface of the surfaces 371 and 372 of the light reflecting unit may be formed to be parallel to each other.

An inside of the light reflecting units 371 and 372 may be formed as a space 37 having a predetermined shape and a cross-section of the space 37 may be a triangle.

An apex 373 which is in contact with the both surfaces 371 and 372 of the light reflecting unit is disposed so as to be shifted a little bit to one side (a left side in FIG. 3) from a center 15C of the light emitting surface of the light source 15 so that light which is radiated from the center 15C of the light source is incident toward an upper portion of one surface (a right surface 372 in FIG. 3) of both surfaces 371 and 372 of the light reflecting unit and then reflected toward one surface (the right surface 342 in FIG. 3) of the both surfaces 341 and 342 of the light guiding unit 34. Therefore, the illumination is improved and the hot spot phenomenon is prevented.

In the meantime, tilt angles θ3 and θ4 of the both surfaces 371 and 372 of the light reflecting unit may be equal to each other or different from each other.

In the above description, it is desirable that between the both surfaces 371 and 372 of the light reflecting unit, one surface (the right surface 372 in FIG. 3) which is opposite to a direction (the left side in FIG. 3) where the apex 373 is shifted from the center 15C of the light source has a tilt angle θ4 which is smaller than a tilt angle θ3 of the other surface, so that the light which is incident from the center 15C of the light source is guided to be reflected to one surface (the right surface 342 in FIG. 3) between both surfaces of the light guiding unit.

As described above, the light guiding unit 34 has two light guide passages 34*a* and 34*b* in which an interval between the both surfaces 341 and 342 which are disposed outside and the both surfaces 371 and 372 of the reflecting unit which are disposed inside is gradually increased toward the lens unit 31. Therefore, light which is radiated from the light source 15 is incident onto the lens unit 31 along the light guide passages 34*a* and 34*b* so that light leakage is prevented and a light distribution performance is improved.

The light guiding unit 34 may have a trapezoidal cross section in which the interval between both surfaces 341 and 342 is gradually increased toward the lens unit 31.

A plurality of convex portions 32 is formed on an outer surface of the lens unit 31 which is opposite to the light guiding unit 34 so that the light which is incident onto the lens unit 31 may be more diversely distributed and diffused through the convex portions 32.

Figure 4:
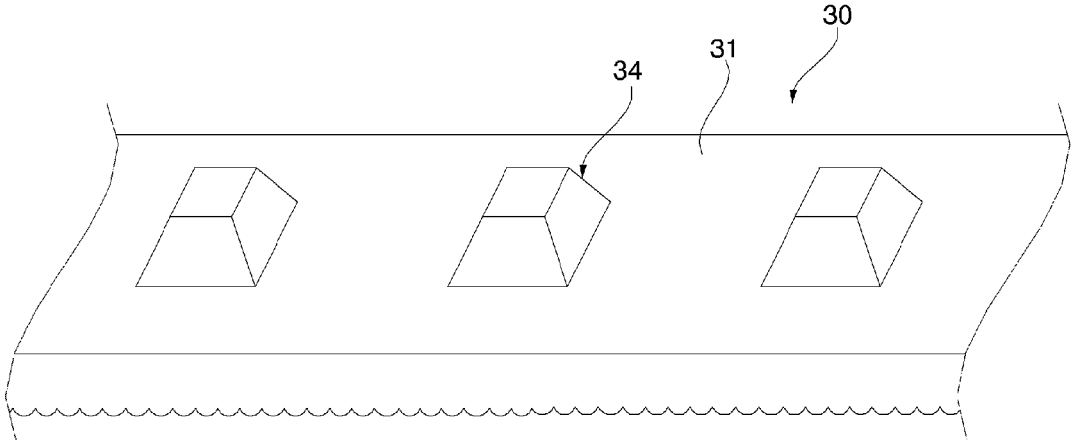
FIG. 4 is a perspective view illustrating a shape of a light guiding unit according to the embodiment of the present invention.
Figure 5:
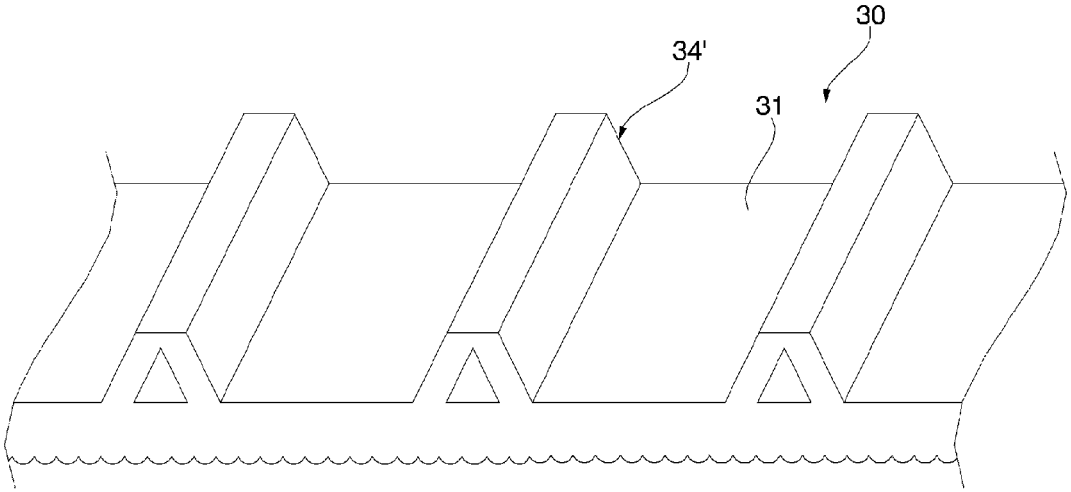
FIG. 5 is a perspective view illustrating a shape of a light guiding unit according to another exemplary embodiment of the present invention.

In the meantime, a light guiding unit 34 or 34' may be formed to have a quadrangular pyramid shape 34 having a flat upper side as illustrated in FIG. 4 or formed to have a trapezoidal cross-section 34' which extends from the lens unit 31 in back and front direction as illustrated in FIG. 5. Even though not illustrated in the drawings, the light guiding unit may be formed to have a circular conical shape having a flat upper side.

According to the lamp device for a vehicle according to the exemplary embodiment of the present invention configured as described above, when the light source 15 operates to radiate the light from the light source 15, light radiated from one light source 15 is guided into the lens unit 31 through V shaped light guide passages 34*a* and 34*b* which are divided into two parts and gradually expand, so that an amount of leaked light which is leaked through the side of the light source 15 is reduced. One light source 15 serves as two light sources so that a predetermined light distribution performance may be achieved even by a reduced number of light sources 15.

The apex 373 of the reflecting unit which is formed in the light guiding unit 34 is located so as to be shifted to one side from the center 15C of the light emitting surface of the light source 15 or the tilt angles of both surfaces of the light reflecting unit are formed to be different from each other, so that a part of light which is radiated from the center of the light emitting surface of the light source is totally reflected from one surface of both surfaces and guided by the light guide passages to be incident onto the lens unit 31, thereby reducing the hot spot phenomenon.

Preferred embodiments of the present invention have been illustrated and described above, but the present invention is not limited to the above-described specific embodiments, it is obvious that various modifications may be made by those skilled in the art, to which the present invention pertains without departing from the gist of the present invention, which is claimed in the claims, and such modifications should not be individually understood from the technical spirit or prospect of the present invention.

What is claimed is:

1. A lamp device for a vehicle, comprising:

a light source; and an inner lens through which light emitted from the light source passes, wherein the inner lens includes:

a lens unit which diffuses the light which is emitted from the light source, and a light guiding unit positioned between the light source and the lens unit, the light guiding unit including two light guide passages which share a planar top surface of the light guiding unit, the two light guide passages extended from the planar top surface of the light guiding unit and branched from each other, wherein a bottom surface of each of the two light guide passages is connected to a planar top surface of the lens unit, wherein the two light guide passages guide the light received by the planar top surface of the light guiding unit to the planar top surface of the lens unit such that the lens unit diffuses the light, wherein a light reflecting unit is formed in the light guiding unit, wherein the light reflecting unit includes two surfaces obliquely formed to have an interval which is gradually increased toward the lens unit, and wherein an apex which is in contact with the two surfaces of the light reflecting unit is located to be shifted to one side from a center of the light source.

2. The lamp device for a vehicle of claim 1, wherein the planar top surface of the light guiding unit is formed to be parallel to a light emitting surface of the light source.

3. The lamp device for a vehicle of claim 2, wherein the planar top surface of the light guiding unit is formed to have substantially the same area as the light emitting surface of the light source.

4. The lamp device for a vehicle of claim 1, wherein outer surfaces of the two light guide passages are obliquely formed to have an interval which is gradually increased toward the planar top surface of the lens unit from the planar top surface of the light guiding unit.

5. The lamp device for a vehicle of claim 4, wherein the outer surfaces of the two light guide passages are formed to have different tilt angles with respect to the planar top surface of the lens unit.

6. The lamp device for a vehicle of claim 4, wherein a reflecting layer is formed on the outer surfaces of the two light guide passages.

7. The lamp device for a vehicle of claim 1, wherein the two light guide passages include inner surfaces facing each other between the planar top surface of the light guiding unit and the planar top surface of the lens unit, wherein a reflecting layer which reflects the light is formed on the inner surfaces of the two light guide passages to prevent the light emitted from the light source from being delivered to a portion of the planar top surface of the lens unit, the portion being surrounded by the inner surfaces of the two light guide passages.

8. The lamp device for a vehicle of claim 1, wherein one surface of the light guiding unit and one corresponding surface of the light reflecting unit are formed to be parallel to each other.

9. The lamp device for a vehicle of claim 1, wherein a space having a predetermined shape is formed in the light reflecting unit.

10. The lamp device for a vehicle of claim 9, wherein a cross-section of the space is a triangle.

11. The lamp device for a vehicle of claim 1, wherein the two light guide passages are branched with an interval which is gradually increased toward the lens unit.

12. The lamp device for a vehicle of claim 1, wherein a plurality of light sources is formed and a plurality of light guiding units is formed corresponding to the light sources.

13. The lamp device for a vehicle of claim 1, wherein the light source is an LED and the LEDs are formed on a printed circuit board so as to be spaced apart from each other.

14. The lamp device for a vehicle of claim 1, wherein a bezel is disposed at an outer side of the inner lens which is opposite to the light source.

15. The lamp device for a vehicle of claim 1, wherein a cross-section of the light guiding unit has a trapezoidal shape in which an interval between outer surfaces of the two light guide passages is gradually increased toward the lens unit.

16. The lamp device for a vehicle of claim 1, wherein a plurality of convex portions is formed on an outer surface of a main body which is opposite to the light guiding unit.

* * * * *